US006345421B1

(12) United States Patent
Dischler

(10) Patent No.: US 6,345,421 B1
(45) Date of Patent: Feb. 12, 2002

(54) FABRIC TREATMENT APPARATUS COMPRISING EASILY REMOVABLE, LIGHTWEIGHT, TREATMENT TUBES

(75) Inventor: Louis Dischler, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/570,426

(22) Filed: May 12, 2000

(51) Int. Cl.[7] ..... D06C 11/00
(52) U.S. Cl. ..... 26/28; 26/29 R
(58) Field of Search ..... 26/28, 27, 37, 26/29 R, 32, 99, 30, 100; 492/15, 27, 28, 29, 30; 28/162, 163, 165, 170; 451/49, 178, 188, 190, 207, 209, 210

(56) References Cited

U.S. PATENT DOCUMENTS 3,894,318 A * 7/1975 Ito et al. ..... 26/28
4,253,392 A * 3/1981 Brandon et al. ..... 492/27
4,255,038 A * 3/1981 Simon et al. ..... 492/4
5,752,300 A * 5/1998 Dischler ..... 26/28
5,784,961 A * 7/1998 Lorig et al. ..... 492/27
5,815,896 A * 10/1998 Dischler ..... 26/28
6,250,114 B1 * 6/2001 Traenkle ..... 66/152

* cited by examiner

*Primary Examiner*—Amy B. Vanatta
(74) *Attorney, Agent, or Firm*—Terry T. Moyer; William S. Parks

(57) ABSTRACT

The present invention concerns easily removable treatment tubes from fabric treatment apparatuses in order to facilitate replacement of such rolls for treatment modification, cleaning, disposal, or any other desirable purposes. Such treatment tubes are generally hollow and may be coated with any standard fabric treatment surface, including sandpaper, diamond grit, wires, brushes, and the like. The ability to easily remove and dispose of such treatment tubes thus provides a significant cost advantage to the manufacturer.

22 Claims, 5 Drawing Sheets

FIG. –1–

FABRIC TREATMENT APPARATUS COMPRISING EASILY REMOVABLE, LIGHTWEIGHT, TREATMENT TUBES

FIELD OF THE INVENTION

The present invention concerns easily removable treatment tubes from fabric treatment apparatuses in order to facilitate replacement of such rolls for treatment modification, cleaning, disposal, or any other desirable purposes. Such treatment tubes are generally hollow and may be coated with any standard fabric treatment surface, including sandpaper, diamond grit, wires, brushes, and the like. The ability to easily remove and either convert or dispose of such treatment tubes thus provides a significant time-savings and cost advantage to the manufacturer.

BACKGROUND OF THE PRIOR ART

Materials such as fabrics are characterized by a wide variety of functional and aesthetic characteristics. Of those characteristics, a particularly important feature is fabric surface feel or "hand." The significance of a favorable band in a fabric is described and explained in U.S. Pat. Nos. 4,918,795 and 4,837,902, both to Dischler, the teachings of which are both entirely incorporated herein by reference.

Favorable hand characteristics of a fabric are usually obtained upon conditioning of prepared textiles (i.e., fabrics which have been de-sized, bleached, mercerized, and dried). Prior methods of prepared-fabric conditioning have included roughening of the finished product with textured rotatably driven cylindrical rolls. Such roll treatments provide extremely efficient and rapid conditioning methods by permitting the treatment of a continuous web of fabric with a roughened surface. The cylindrically shaped rolls will contact substantial every area of the target fabric web, no matter the speed of the web over the rolls. Thus, these methods have proven to be efficient and cost-effective within the treated textile industry. Examples of such cylindrical roll treatments may be found in U.S. Pat. No. 5,752,300 to Dischler, and U.S. Pat. No. 3,973,359 to Spencer, both hereby entirely incorporated by reference. Processes such as sueding, sandind, napping, brushing (with soft or stiff bristles), and the like, are practiced with such cylindrical rolls.

Sueding and sanding both concern finishing woven fabrics by abrading one or both surfaces of the target fabric using sandpaper or a similarly abrasive material (i.e., diamond grit) to cut and raise the fibers of the constituent yarns in the fabric. Through such a treatment, a resultant fabric is obtained generally exhibiting a closely raised nap producing a soft, smooth surface texture resembling suede leather. Such operations are conventionally performed by a specialized fabric sueding or sanding machine wherein the fabric is passed under tension over one or more finishing rolls, covered with sandpaper or a similarly abrasive material, which are rotated at a differential speed relative to the moving fabric web.

Napping also concerns a surface-raising treatment for a target fabric. Such a treatment provides a fabric exhibiting a softer hand, improved drapeability, greater fabric thickness, and better overall durability. Napping machinery generally utilizes such rotatably driven cylinders including peripheral wire teeth, such as, normally, card clothing, over which the fabric travels under a certain amount of tension.

Such cylindrical rolls have been introduced within standard fabric treatment apparatuses through a relatively simple lay-in procedure with engagement to drive belts on either one or both ends of the roll with a locking mechanism to ensure substantially no movement from the laid-in position. However, such a method is, initially, quite cumbersome in that the rolls are generally of great weight and width and require large amount of manpower to maneuver out, through, and/or around the potentially delicate fabric treatment apparatus machinery. This has proven troublesome in the past when differing treatment surfaces are required for different fabric types; or when the treatment surface has become eroded or worn down sufficiently to prove ineffective in treating the target fabric surface; or any other necessity for exchanging, substituting, replacing, or otherwise removing such rolls have become imperative. A lighter weight, easier to maneuver, and easier to dispose of cylindrical treatment article would thus be of great benefit to the industry, particularly if removal is also a rather simple, non-obstructive, and cost-effective (in terms of manpower and time). To date, there have been no such improvements accorded the industry.

OBJECTS OF THE INVENTION

The primary object of this invention is therefore to provide an easy and simple procedure for replacing and/or removing cylindrical treatment articles from fabric treatment apparatuses. It is thus an additional advantage of this invention to provide tubular treatment articles which are substantially hollow, and thus lightweight, yet provide a sufficiently solid surface for desired fabric finishing. Another object of this invention is to provide a method of easily removing such lightweight tubular fabric treatment articles from such apparatuses. Accordingly, this invention encompasses a fabric treatment apparatus comprising at least one abrasive treatment tube located on an axis and having two separate ends, wherein a first end is engaged to a beveled drive mechanism, and wherein a second end is engaged to a beveled clamp mechanism, wherein said tube is removed from said fabric treatment apparatus through disengagement of said second end from said beveled clamp mechanism and moving said treatment tube in the axial direction away from said first end. Also, this invention encompasses a fabric treatment apparatus comprising at least one abrasive treatment tube located on an axis and having two separate ends, wherein a first end is engaged to a beveled drive mechanism, and wherein a second end is engaged to a second beveled mechanism which is attached to a coupling mechanism, wherein said tube is removed from said fabric treatment apparatus through disengagement of said coupling mechanism and moving said treatment tube in the axial direction away from said first end.

These and other advantages will be in part apparent and in part pointed out below, particularly within the non-limiting, yet preferred embodiments depicted and described within the accompanying drawings.

DETAILED DESCRIPTION OF THE DRAWINGS

Figure 1:
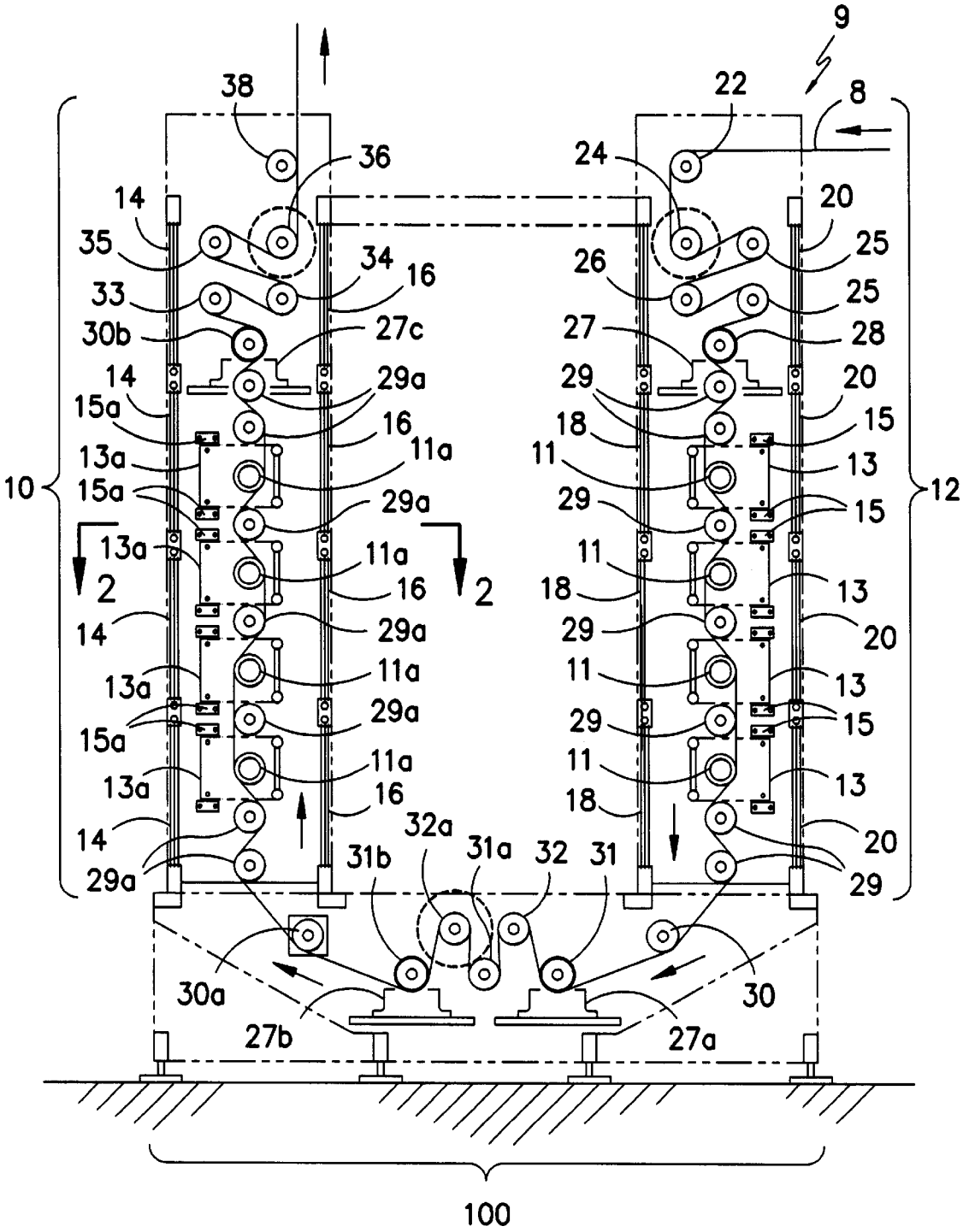
FIG. 1 represents a cross-sectional view of the preferred fabric treatment apparatus.

As depicted in FIG. 1, a web of fabric 8 is moved through an apparatus 9 having two separate treatment chambers 10, 12, and an intermediate chamber 100. After the web 8 enters the first treatment chamber 12, it is directed over idler roll 22 to drive rolls 24, 26, which are geared together in a one-to-one relationship by means of a synchronous belt (not shown). Sufficient wrap on the drive rolls to achieve traction on the web is accomplished by directing the web over idler rolls 25. The fabric is then directed over idler roll 28, equipped with load cell blocks 27 mounted on each end of idler roll 28. The output from load cell blocks 27 (serving the same purpose as a dancer roll) is used to regulate the relative speed of drive rolls 24, 26 with the next pair of drive rolls 32, 32*a*, and thereby control the tension of the web 8.

The web is then directed into contact with abrasive treatment tubes 11, 11*a*, which are interspersed with idler rolls 29, 29*a*. Such treatment tubes 11, 11*a* may be coated with any standard fabric treatment surface, such as sandpaper, diamond grit, and the like, or other treatment articles, such as brushes, wire, card-cloths, and the like, may be attached thereto. Also, such treatment tubes 11, 11*a* are made of any sturdy material, such as metal, thermoplastic, wood, and the like. Preferably such tubes 11, 11*a* are made of steel. The drawings show a particular orientation of the web 8 to the treatment tubes 11 wherein first one side and then the other side of the web is contacted by the treatment rolls 11. However, the idler rolls 29 and treatment tubes 11 are symmetrically oriented in a line, so that the web path may be altered by threading up the web to either side of the treatment tubes 11, so that either the face or back of the web is treated by a particular treatment tube 11, as desired for a particular fabric style.

After treatment in chamber 12, the web 8 passes into intermediate chamber 100, passing under scroll roll 30 to idler roll 31, which is mounted each end on load cell blocks 27*a*, whereby tension of the web 8 is measured and compared to the tension measured with load cells 27, as a quality check. The web is then directed to drive roll 32, to idler roll 31*a* and to drive roll 32*a*, geared in a one to one relationship with drive roll 32. Subsequently, the web 8 passes under idler roll 31*b*, equipped at each end with load cell blocks 27*b*, which serve to control to tension of the web 8 in treatment chamber 10.

The output from load cell blocks 27*b* is used to regulate the relative speed of drive rolls 32, 32*a* with the next pair of drive rolls 34, 36, and thereby control the tension of the web 8 within the chamber 10.

The web passes under scroll roll 30*a*, which serves to further open the web before entering the treatment chamber 10. This opening is particularly desirable if the tension used in the treatment chamber 10 is less than that used in treatment chamber 12.

The fabric web 8 then enters treatment chamber 10, wherein spaced idler rolls 29*a* serve to contact the web against treatment tubes 11*a*. Again, the drawings show a particular orientation of the web to the treatment tubes 11*a* wherein first one side and then the other side of the web is contacted by the treatment tubes 1 a. However, the idler rolls 29*a* and treatment tubes 11*a* are symmetrically oriented in a line, so that the web path may be altered so that either that the face or back of the web is treated by a particular treatment tube la, as desired for a particular fabric style.

After treatment in chamber 10, the fabric is directed around idler roll 30*b*, equipped at each end with load cell blocks 27*c*, whereby tension of the web 8 is measured and compared to the tension measured with load cells 27*b*, as a quality check. Subsequently, the web 8 is directed over idler roll 33 to drive rolls 34, 36, which are geared together in a one-to-one relationship by means of a synchronous belt (not shown). Sufficient wrap on the drive rolls to achieve traction on the web is accomplished by directing the web over idler rolls 35, 38. The web is then directed away from the apparatus 9.

The entire apparatus 9 is sealed to prevent leakage of lint into the environment. Slideable windows 14, 16, 18, 20 allow the treatment areas to be accessed and viewed. Lint created by contact of the web 8 with the treatment tubes 11 falls into the intermediate chamber 100 and is removed by ductwork attached thereto (not shown). Most preferably, the outer surface of such a treatment tube 11, Ha is coated with diamond grit in an electroplated nickel matrix. Furthermore, the tubes 11, 11*a* are removable through doors 13, 13*a* which rotate in relation to hinges 15, 15*a*. Such a configuration facilitates replacement of such tubes 11, 11*a* with minimal time requirements.

Figure 2:
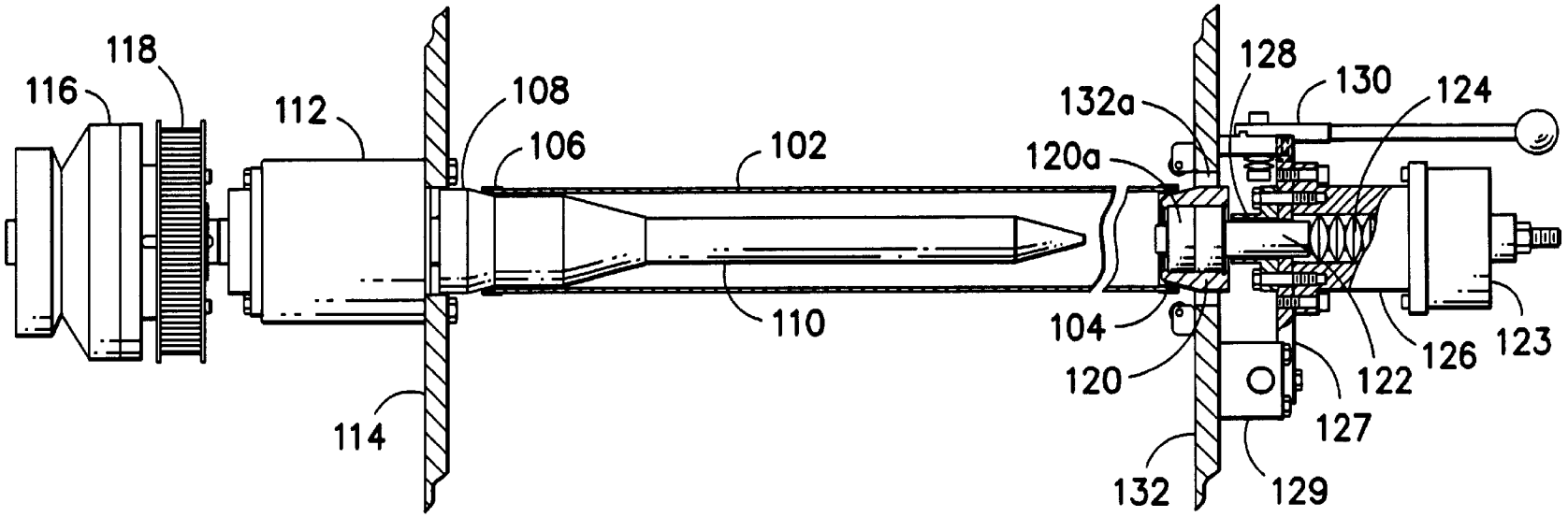
FIG. 2 depicts an aerial view of the treatment tube along line 2 in FIG. 1.
Figure 3:
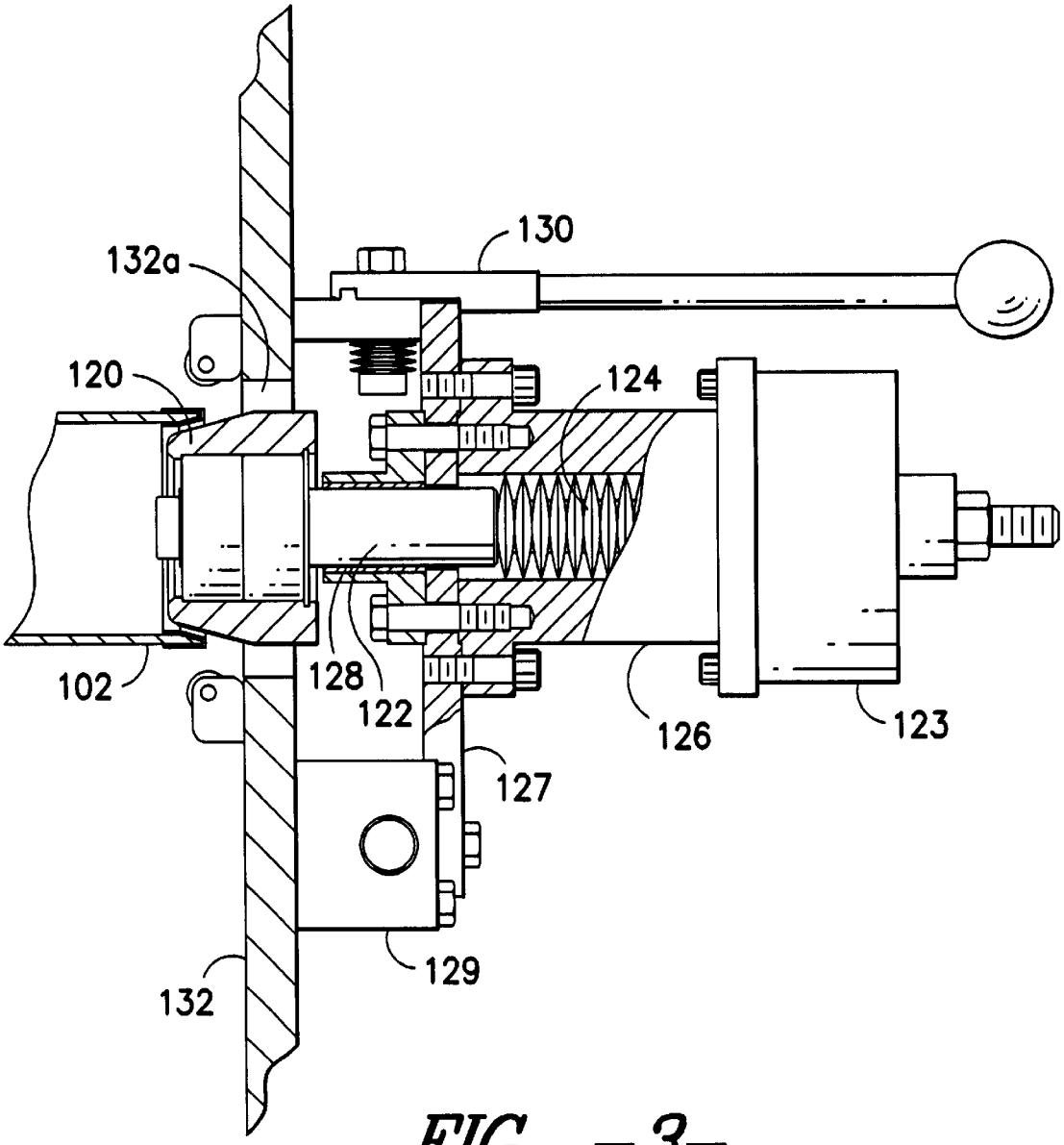
FIG. 3 shows an aerial view of the preferred clamping mechanism in restraining position for clamping the inventive tube to the treatment apparatus.
Figure 4:
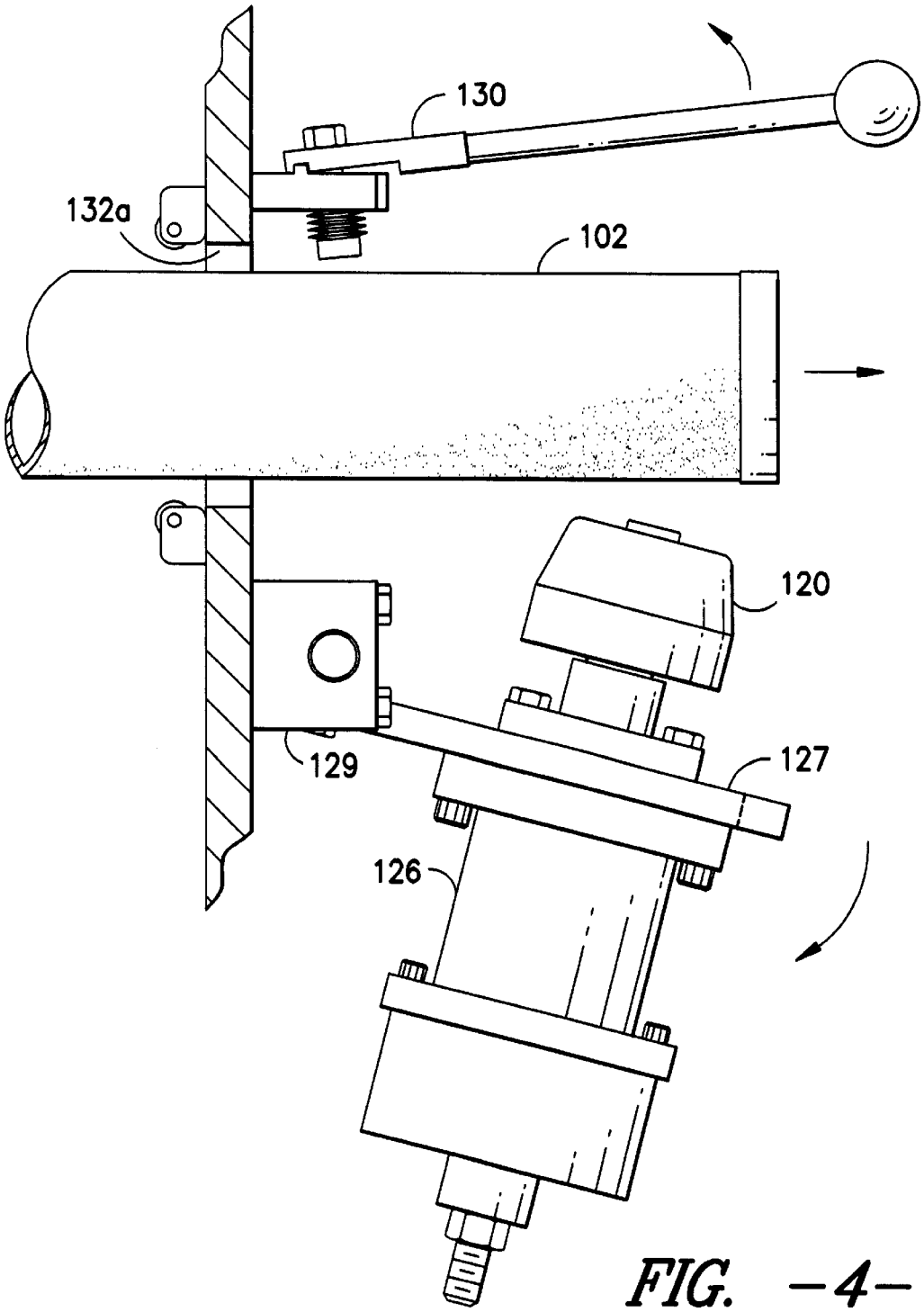
FIG. 4 shows an aerial view of the preferred clamping mechanism of FIG. 3 in non-restraining position.

As shown in FIG. 2, the tube 102 is hollow and has an internal 15-degree bevel on each end. A urethane rubber cushion 104, 106 caps each end of the tube to act as a transmission element, preventing metal to metal contact and resultant wear. Such rubber caps 104, 106 are thus are of extreme importance in permitting such a lightweight tube 102 to be utilized with heavy web tensions without damaging either the drive cone 108 or mating tube bevel due to tube deflection resulting from heavy web tensions, which would result in squirming and rapid wear of the contacting metal surfaces. The tube is driven by pressure engagement (via the cushion 104, 106) with the drive cone 108, which has a mating 15-degree bevel. Extending from the drive cone 108 is a guide shaft 110, which serves to support and guide the tube 102 during replacement. The guide shaft 110 extends back through the drive cone 108, supported by a pair of bearings (not illustrated) located in a bearing housing 112 mounted to a first bulkhead 114, and is driven by means of a drive sprocket 118 (drive motor and belt not shown), coupled to the guide shaft by means of a clutch 116. Pressure contact of the tube with the drive cone 108 is maintained by a freewheeling clamp cone 120 (as shown in all of FIGS. 2, 3, and 4), which contains a pair of angular contact bearings 120*a* mounted on a clamp shaft 122. The clamp cone 120 is driven into the treatment tube 102 via the clamp shaft 122 by an air cylinder 123. Auxiliary pressure (in the event of a loss of air pressure) is developed by Belleville disk springs 124 surrounding the clamp shaft 122 and housed in a cylinder mount 126. The clamp shaft 122 is supported by the air cylinder 123 and by a sleeve bearing 128. The cylinder mount 126 is bolted to a door 127 that is supported by a door hinge 129 and by a latch bar 130. Both the hinge 129 and latch bar 130 are mounted to a second bulkhead 132. As shown in FIG. 4, if the latch bar 130 is opened, the door 127 can swing at least 90 degrees, preferably more, allowing the treatment tube 102 to be extracted and replaced through the second bulkhead 132 through access hole 132*a*.

Figure 5:
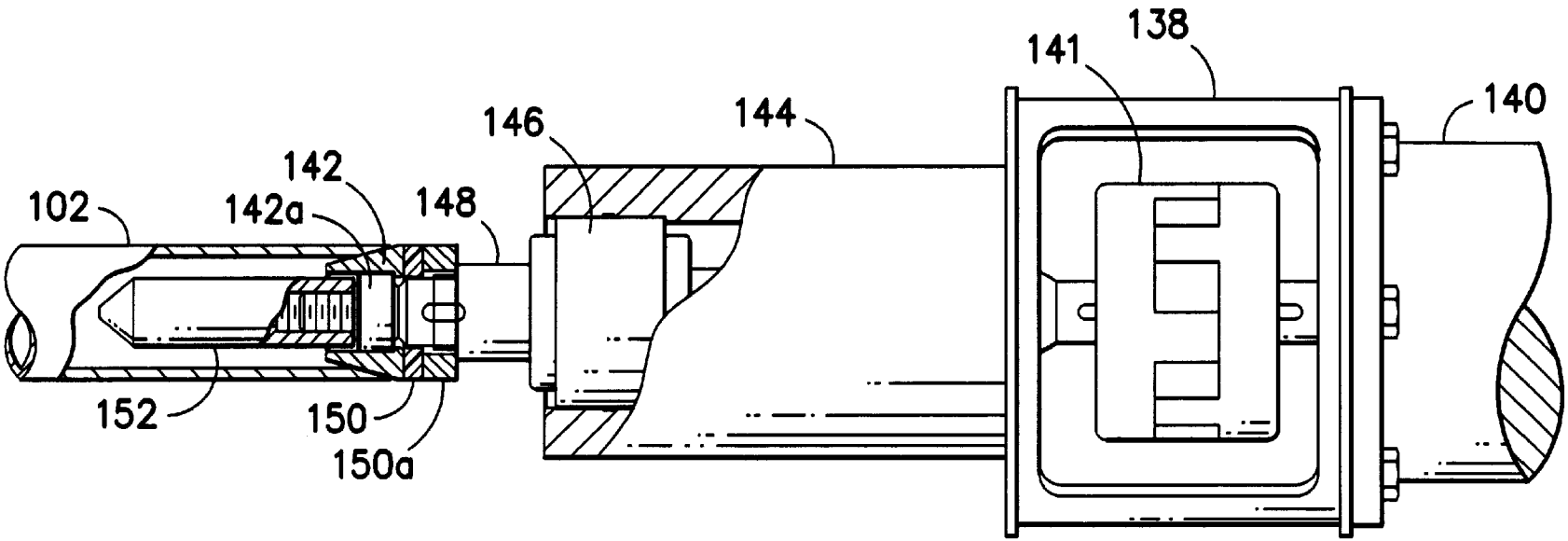
FIG. 5 shows an aerial view of an alternative, yet preferred, embodiment of a coupling device to hold the inventive tube in position on the treatment apparatus.

FIG. 5 presents an alternative drive mechanism for tube 102. As in FIG. 1, tube 102 is hollow and has an internal 15-degree bevel on each end. The tube is driven by pressure engagement with the drive cone 142, which has a mating 15-degree bevel. The drive cone is supported on the drive shaft 148 by means of a spherical bearing 142*a*. The spherical bearing accommodates axial misalignment that may occur as the tube deflects under heavy side loads imparted by contact with a web under high tension. The drive cone 142 is coupled to a drive disk 150*a* by means of a compressible rubber ring 150. Other coupling means may be used, e.g., pins or keys. The drive disk 150*a* is keyed to the drive shaft 148, and is coupled to the drive motor 140 by means of coupling 141 within a coupling housing 138. The drive shaft 148 is supported by first bearing 146 and by a second bearing (not shown), both contained within housing 144. Guide shaft 152, which supports the tube 102 during installation, is threadably attached to the drive shaft 148, and also serves to retain spherical bearing 142*a*. A gasket (not illustrated) may also be employed between tube 102 and drive cone 142, to further cushion and protect the drive surfaces.

It is not intended that the scope of the invention be limited to the specific embodiments and/or figures described herein, rather, it is intended that the scope of the invention be defined by the appended claims and their equivalents.

What is claimed is:

1. A fabric treatment apparatus comprising at least one abrasive treatment tube located on an axis and having two separate ends, wherein a first end is engaged to a drive mechanism, and wherein a second end is engaged to a movable clamp mechanism, wherein said tube is removable from said fabric treatment apparatus through disengagement of said second end from said clamp mechanism and moving said entire treatment tube in the axial direction away from said drive mechanism and through the area occupied by said movable clamp mechanism prior to disengagement from said treatment tube.

2. The apparatus of claim 1 wherein said abrasive treatment tube is supported by a shaft when disengaged from both of said drive mechanism and said clamp mechanism.

3. The apparatus of claim 1 wherein said abrasive treatment tube comprises a gasket on at least one of said first end and second end, wherein said gasket accomodates misalignment with at least one of the drive mechanism and the clamp mechanism.

4. The apparatus of claim 2 wherein said abrasive treatment tube comprises a gasket on at least one of said first end and second end, wherein said gasket accomodates misalignment with at least one of the drive mechanism and the clamp mechanism.

5. The apparatus of claim 1 wherein at least one of said first end and said second end of said abrasive treatment tube is beveled and said drive mechanism comprises a mating bevel in relation to said tube bevel.

6. The apparatus of claim 1 wherein at least one of said first end and said second end of said abrasive treatment tube is beveled and said clamp mechanism comprises a mating bevel in relation to said tube bevel.

7. The apparatus of claim 1 wherein said drive mechanism is a beveled drive cone.

8. The apparatus of claim 1 wherein said clamp mechanism is a beveled clamp cone.

9. The apparatus of claim 3 wherein said gasket is comprised of rubber.

10. The apparatus of claim 1 wherein said abrasive treatment tube is at least partially covered with an abrasive substance selected from the group consisting of abrasive grit, sandpaper, wire, card-cloth, brushes, and any combinations thereof.

11. The apparatus of claim 10 wherein said abrasive substance is abrasive grit.

12. The apparatus of claim 11 wherein said abrasive grit is diamond grit.

13. The apparatus of claim 10 wherein said abrasive treatment tube comprises steel.

14. A fabric treatment apparatus comprising at least one abrasive treatment tube located on an axis and having two separate ends, wherein a first end is engaged to a drive mechanism which is attached to a coupling mechanism, and wherein a second end is engaged to a movable clamp mechanism, wherein said tube is removable from said fabric treatment apparatus through disengagement of said coupling mechanism and said clamp mechanism and moving said entire treatment tube in the axial direction away from said drive mechanism and through the area occupied by said movable clamp mechanism prior to disengagement from said treatment tube.

15. The apparatus of claim 14 wherein said abrasive treatment tube is supported by a shaft when disengaged from both said drive mechanism and said clamp mechanism.

16. The apparatus of claim 14 wherein said abrasive treatment tube comprises a gasket on at least one of said first and second end, wherein said gasket accomodates misalignment with at least one of said drive mechanism and said clamp mechanism.

17. The apparatus of claim 14 wherein said drive mechanism is a beveled drive cone.

18. The apparatus of claim 16 wherein said gasket is comprised of rubber.

19. The apparatus of claim 14 wherein said abrasive treatment tube is at least partially covered with an abrasive substance selected from the group consisting of abrasive grit, sandpaper, wire, card-cloth, brushes, and any combinations thereof.

20. The apparatus of claim 19 wherein said abrasive substance is abrasive grit.

21. The apparatus of claim 20 wherein said abrasive grit is diamond grit.

22. The apparatus of claim 19 wherein said abrasive treatment tube comprises steel.

* * * * *